US006081973A

United States Patent [19]

Liu

[11] Patent Number: 6,081,973

[45] Date of Patent: Jul. 4, 2000

[54] BELT BUCKLE DEVICE

[76] Inventor: Wo-Chou Liu, No.31, Lane 22, Chu-Chung Rd., Chang-Hua City, Taiwan

[21] Appl. No.: 09/336,800

[22] Filed: Jun. 21, 1999

[51] Int. Cl.[7] ..... A44B 11/00; A41F 9/00

[52] U.S. Cl. ..... 24/178; 24/170; 24/585

[58] Field of Search ..... 24/163 R, 170, 24/178, 179, 190, 191, 200, 265 WS, 265 B, 265 BC, 585, 629, 316, 323; 20/321, 322, 333

[56] References Cited

U.S. PATENT DOCUMENTS

| | | | |
|---|---|---|---|
| 3,466,668 | 9/1969 | Ochiai | 24/585 X |
| 4,669,155 | 6/1987 | Chen | 24/170 |
| 4,942,647 | 7/1990 | Wallner | 24/170 |
| 5,572,747 | 11/1996 | Cheng | 24/585 X |
| 5,588,184 | 12/1996 | Chen | 24/170 |
| 5,588,186 | 12/1996 | Ko | 24/585 |
| 5,615,459 | 4/1997 | Wu | 24/191 X |
| 5,806,145 | 9/1998 | Chen | 24/170 |

*Primary Examiner*—James R. Brittain
*Assistant Examiner*—Robert J. Sandy
*Attorney, Agent, or Firm*—Charles E. Baxley, Esq.

[57] ABSTRACT

A belt buckle device includes a frame having an engaging part for securely connecting one end of a belt and a plate extends from the frame and toward the engaging part. Two lugs respectively extend laterally from a rear side of the frame and a rotatable member is rotatably connected between the two lugs. The rotatable member has a protrusion extending radially outward from the rotatable member which is actuated by an actuating device to maintain the protrusion to be engaged with the belt passing between the rotatable member and the frame.

5 Claims, 3 Drawing Sheets

BELT BUCKLE DEVICE

FIELD OF THE INVENTION

The present invention relates to a belt buckle device, and more particularly, to an improved buckle device having a frame with a rotatable member which has a protrusion to engage with the belt passing between the rotatable member and the frame.

BACKGROUND OF THE INVENTION

A conventional belt buckle device generally includes a frame which has a tongue extending from one of two ends of the frame so that the belt extends through the frame and the tongue is engaged with one of the apertures in the belt. However, the periphery defining the aperture which is often used to engage with the tongue will be deformed, elongated or even broken, and the deformed aperture can be seen when wearing the belt. Another belt buckle device includes a board-type member which has a tongue extending from the rear side of the board-type member, the belt passes by the rear side of the board-type member so that the tongue may extends through one of the apertures in the belt. When operating either one of the two conventional belt buckle devices, the frame or the board-type member has to be pulled outwardly so that the tongue can be disengaged from the aperture of the belt.

The present invention intends to provide a belt buckle device which has a rotatable member with a protrusion which is engaged with or disengaged from the belt by simply pushing a button on the frame.

SUMMARY OF THE INVENTION

In accordance with one aspect of the present invention, a belt buckle device is provided and comprises a frame having an engaging part to be connected to an end of the belt and a plate extends toward the engaging part from the frame. A first lug and a second lug respectively extend laterally from a rear side of the frame. A rotatable member is rotatably connected between the first lug and the second lug. The rotatable member has a protrusion extending radially outward therefrom. An actuating means is connected to the rotatable member so that the protrusion is engaged with the belt passing through the rotatable member and the frame.

The object of the present invention is to provide a belt buckle device which has a rotatable member engaged with a belt by pushing a button on the frame of the device.

Further objects, advantages, and features of the present invention will become apparent from the following detailed description with appropriate reference to the accompanying drawings.

DETAILED DESCRIPTION OF THE PREFERRED EMBODIMENT

Figure 1:
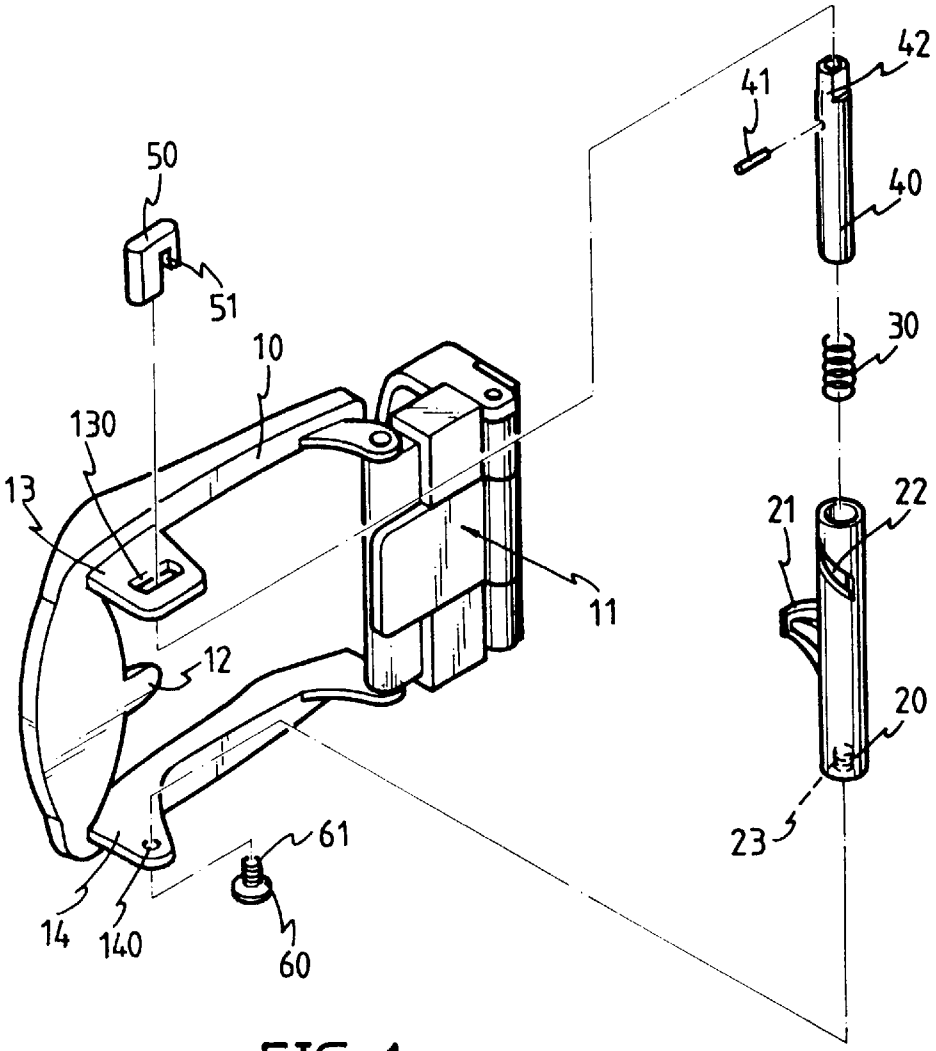
FIG. 1 is an exploded view of the belt buckle device in accordance with the present invention.
Figure 2:
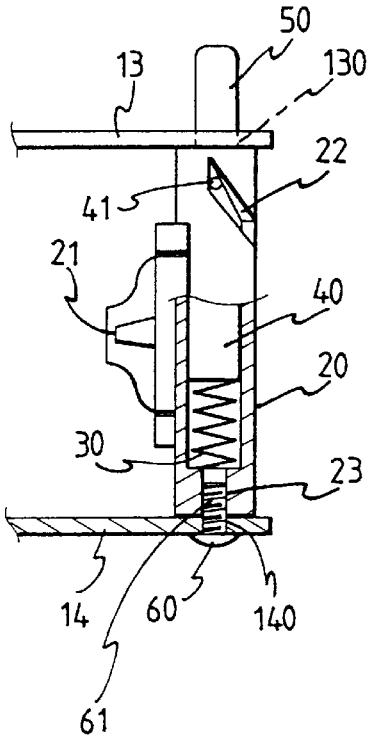
FIG. 2 is a side elevational view, partly in section, of the belt buckle device in accordance with the present invention, wherein the button is mot yet pushed.
Figure 2A:
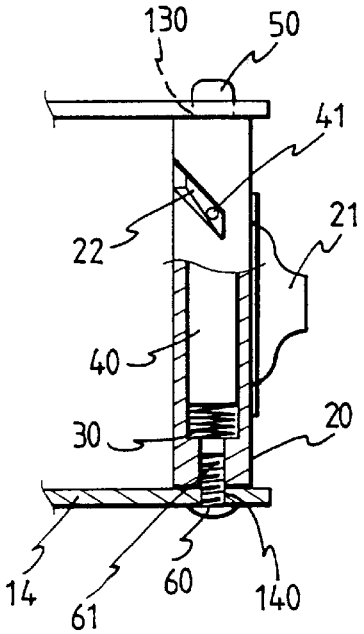
FIG. 2A is a side elevational view, partly in section, of the belt buckle device in accordance with the present invention, wherein the button is pushed.
Figure 3:
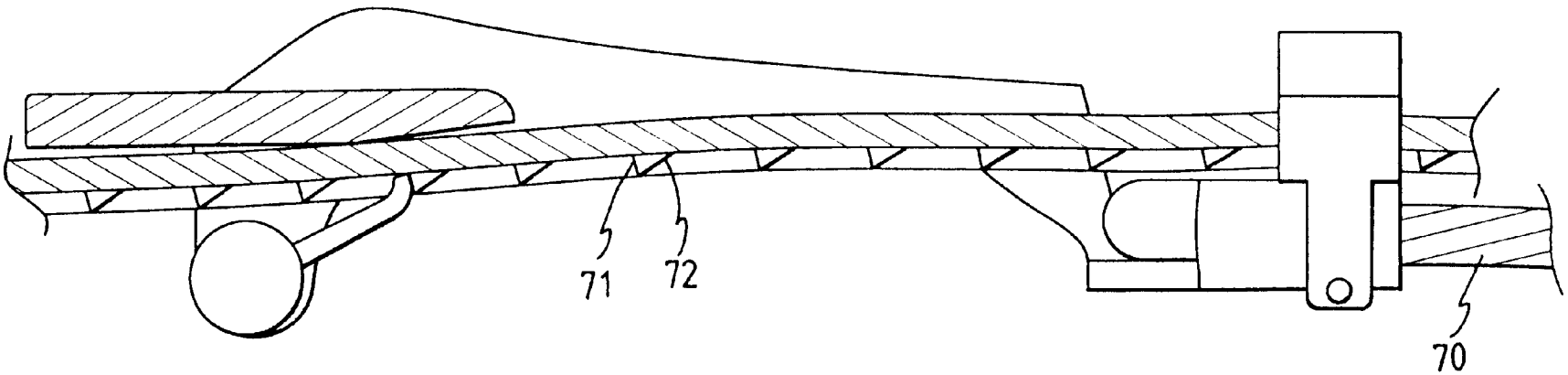
FIG. 3 is a top cross-sectional view to show that the protrusion of the rotatable member is engaged with the belt.

Referring to FIGS. 1, 2, 2A and 3, the belt buckle device in accordance with the present invention comprises a frame

(10) having an engaging part (11) connected to the first end of the frame (10) so as to fixedly connected an end of a belt (70) and a plate (12) extends toward the engaging part (11) from the second end of the frame (10). A first lug (13) and a second lug (14) respectively extend laterally from a rear side of the frame (10). The first lug (13) has a first hole (130) defined therethrough which is a square hole and the second lug (14) has a second hole (140) defined therethrough.

A rotatable member (20) is rotatably connected between the first lug (13) and the second lug (14), wherein the rotatable member (20) has a protrusion (21) extending radially outward from the rotatable member (20). The rear side of the belt (70) has a plurality of notches (71) defined therein so that the protrusion (21) is engaged one of the notches (71) of the belt (70) passing through the rotatable member (20) and the frame (10) to position the belt (70) relative the frame (10). The rotatable member (20) has a spiral groove (22) defined through the wall thereof. near the first end of the rotatable member (20), a threaded inner periphery (23) defined in the second end of the rotatable member (20). An end member (60) has a threaded rod (61) which rotatably extends through the second hole (140) of the second lug (14), and the threaded rod (61) is fixedly engaged with the threaded inner periphery (23) of the rotatable member (20).

An actuating means comprises a rod (40) inserted in the rotatable member (20) from the first end of the rotatable member (20), and a pin (41) extends radially outward from the rod (40). The pin (41) movably extends through the spiral groove (22). A spring (30) is connected between the first end of the rod (40) and the end member (60) in the rotatable member (20) so that when pushing the rod (40), the rotatable member (20) is rotated to remove the protrusion (21) from the belt (70), wherein the pin (41) moves from a first position in the spiral groove (22) to a second position in the spiral groove (22).

The rod (40) has a neck (42) extending from second end thereof and a button (50) is connected to the second end of the rod (40). The button (50) is movably engaged with the first hole (130) which is a square hole and the button (50) is a square member which has a notch (51) defined in one side thereof so that the neck (42) is engaged with the notch (51) of the button (50) and the button (50) together with the rod (40) can not be rotated.

Accordingly, when using the buckle device, the button (50) is pushed to let the rotatable member (20) rotate and the protrusion (21) is pivoted to remove from the notches (71) of the belt (70) so that the belt (70) can be freely pulled relative to the frame (10). The notches (71) each have an inclined surface (72) so that the belt (70) can be pulled toward the engaging part (11) even if the button (50) is not pushed, the inclined surfaces (72) of the notches (71) will run over the protrusion (21), and when stop pulling the belt (70), one of the notches (71) is engaged with the protrusion (21). It is noted that the plate (12) is located on the outside of the belt (70) where the protrusion (21) is engaged with the belt (70). In other words, the plate (12) and the tip portion of the protrusion (21) is in alignment with each other so that the point of the belt (70) that the protrusion (21) is engaged cannot seen from outside of the frame (10).

The invention is not limited to the above embodiment but various modification thereof may be made. It will be understood by those skilled in the art that various changes in form and detail may made without departing from the scope and spirit of the present invention.

What is claimed is:

1. A belt buckle belt comprising:

a frame (10) having a first end and a second end, an engaging part (11) mounted to the first end of said frame (10), a plate (12) extending toward said engaging part (11) from the second end of said frame (10), a first lug (13) and a second lug (14) respectively extending laterally from a rear side of said frame (10);

a rotatable member (20) rotatably connected between said first lug (13) and said second lug (14), a protrusion (21) extending radially outward from said rotatable member (20), a spiral groove (22) defined in said rotatable member (20);

an actuating means mounted to said rotatable member (20) and including a rod (40) inserted in said rotatable member (20) and having a first end and a second end, a pin (41) extending radially outward from said rod (40) and movably extending through said spiral groove (22), a spring (30) mounted to the first end of said rod (40) so that when pushing said rod (40), said rotatable member (20) is rotated to move said protrusion (21) and said pin (41) is moved in said spiral groove (22); and a square button (50) mounted to the second end of said rod, a notch (51) defined in one side of said button.

2. The belt buckle belt as claimed in claim 1, wherein said rod (40) has a neck (42) extending from the second end thereof and said neck (42) is engaged with said notch (51) of said button (50).

3. The belt buckle belt as claimed in claim 1, wherein said second lug (14) has a second hole (140) defined therethrough and an end member (60) has a threaded rod (61) rotatably extending through said second hole (140), said threaded rod (61) fixedly mounted to said rotatable member (20).

4. The belt buckle belt as claimed in claim 1, wherein said first lug (13) has a first hole (130) defined therethrough and said button (50) is movably engaged with said first hole (130).

5. The belt buckle belt as claimed in claim 4, wherein said first hole (130) has a square shape.

* * * * *